US006875730B2

(12) United States Patent
Kaimai et al.

(10) Patent No.: US 6,875,730 B2
(45) Date of Patent: Apr. 5, 2005

(54) LUBRICANT FOR REFRIGERATING MACHINE EMPLOYING AMMONIA REFRIGERANT

(75) Inventors: Takashi Kaimai, Saitama (JP); Hitoshi Takahashi, Saitama (JP); Goro Yamamoto, Tokyo (JP); Kimiyoshi Namiwa, Tokyo (JP); Ayako Saneyoshi, Tokyo (JP)

(73) Assignees: Asahi Denka Kogyo K.K., Tokyo (JP); Japan Energy Corporation, Tokyo (JP)

( * ) Notice: Subject to any disclaimer, the term of this patent is extended or adjusted under 35 U.S.C. 154(b) by 246 days.

(21) Appl. No.: 10/169,798

(22) PCT Filed: Jan. 19, 2001

(86) PCT No.: PCT/JP01/00360

§ 371 (c)(1),
(2), (4) Date: Jul. 9, 2002

(87) PCT Pub. No.: WO01/53440

PCT Pub. Date: Jul. 26, 2001

(65) Prior Publication Data

US 2003/0027729 A1 Feb. 6, 2003

(30) Foreign Application Priority Data

Jan. 21, 2000 (JP) ..... 2000-013248

(51) Int. Cl.[7] ..... C10M 111/00; C10M 140/00

(52) U.S. Cl. ..... 508/280; 508/251; 508/579; 252/68

(58) Field of Search ..... 508/280, 251, 508/579; 252/68

(56) References Cited

U.S. PATENT DOCUMENTS 5,651,257 A * 7/1997 Kasahara et al. ..... 62/84
5,688,433 A * 11/1997 Kasahara et al. ..... 252/68
6,656,891 B1 * 12/2003 Sakanoue et al. ..... 508/579

* cited by examiner

*Primary Examiner*—Elizabeth D. Wood
(74) *Attorney, Agent, or Firm*—Sughrue Mion, PLLC

(57) ABSTRACT

A lubricant for a refrigerator using ammonia as the refrigerant, which contains an additive selected from antioxidant, anti-wear additive and metal deactivator, and the polyether compound represented by the following general formula (1) or (2):

$$X\{—O—(AO)_n—H\}_p \quad (1)$$

$$X\{—O—(AO^1)_a—(AO^2)_b—H\}_p \quad (2)$$

7 Claims, No Drawings

LUBRICANT FOR REFRIGERATING MACHINE EMPLOYING AMMONIA REFRIGERANT

TECHNICAL FIELD

The present invention relates to a lubricant for a refrigerator using an ammonia refrigerant.

BACKGROUND ART

A compression refrigerator comprises a compressor, a condenser, an expansion mechanism (for example, an expansion valve or a capillary tube), an evaporator and the like, and is an apparatus where a cooling is performed using a characteristic of a refrigerant having a high volatility to take away an heat of evaporation from its surroundings upon the evaporation. This apparatus is being used for vending machines such as a cooler, a freezer, an air conditioning equipment, a show case, soft drink, ice cream or the like. In the air conditioning equipment or the vending machine, the compression refrigerator is being used also for performing the heating or keeping a drink or a food under heating, utilizing a heat generated upon the condensation.

As the above-described refrigerant, a chlorine-containing fluorohydrocarbon (CFC or HCFC) is conventionally used, and it has been replace by a chlorine-free fluorohydrocarbon (HFC) in recent years. However, these fluorohydrocarbons have a problem that the former destroys the ozone layer and the latter has a high global warming effect and therefore, in place of these, such a refrigerant that exerts no adverse effect on the environment is being demanded from the viewpoint of global environment protection. Accordingly, a refrigerant such as hydrocarbon or ammonia having a low molecular weight has been reconsidered as an environment-friendly refrigerant because it does not destroy the ozone layer and is extremely low in global warming effect as compared with the fluorohydrocarbon. In particular, ammonia has a high performance coefficient.

As a base oil of a lubricant for refrigerator using an ammonia refrigerant, a mineral oil or alkylbenzene has been conventionally used. However, a polyether compound having compatibility with ammonia has been proposed in recent years. For example, European Patent Publication 490810 discloses a lubricant comprising a polyalkylene glycol which is a copolymer of ethylene oxide and propylene oxide and has an EO/PO ratio of 4/1. European Patent Publication 585934 discloses a lubricant comprising a monofunctional or difunctional polyalkylene glycol having an EO/PO ratio of 2/1 to 1/2. German Patent Publication 4404804 discloses a polyether-base lubricant represented by the general formula:

$$RO—(EO)_x—(PO)_y—H$$

[wherein R represents C1 to C8 alkyl group, X and Y are numbers from 5 to 55]. International Patent Publication WO 94/12594 discloses a refrigerator oil comprising a polyalkylene glycol diether, which is excellent in the compatibility with ammonia and the stability in an ammoniac atmosphere.

If these polyether compounds having the compatibility with ammonia are used, it is not necessary to provide a lubricant circulator where a lubricant is separated and recovered at the exhaust side of a refrigerating compressor and returned to the compressor.

However, ammonia as a refrigerant is a compound having a high activity, and therefore there is a fear that the ammonia reacts with a base oil or an additive of a lubricant for refrigerator or with the deteriorated material thereof to produce a precipitate (reaction product), which causes blocking of an expansion valve or a capillary portion and the wear of a sliding member, and also accelerate the deterioration of the lubricant. Ammonia has high corrosiveness with respect to a metal material, particularly in the presence of water. Therefore, if ammonia is used together with a polyether compound having high moisture absorption, the corrosion or deterioration of metal materials such as occurrence of rust is accelerated. Further, since an ammonia refrigerant requires a higher pressure driving than a flon-base refrigerant, the refrigerant and the lubricant are exposed to severer conditions such as high temperature and high pressure, and also severer sliding conditions apply. As a result, the increase in the generation of precipitates, the acceleration in the deterioration of a lubricant (base oil and additive) and the increase in the friction or the wear are feared. Accordingly, a lubricant which is stable and high in the lubricity even under the severe conditions encountered when using an ammonia refrigerant, is demanded.

With respect to the polyether compound, polyether compound derivatives (hereinafter referred to as a polyether compound including the derivatives) where the terminal hydroxyl group thereof is substituted by an alkyl group or an acyl group to improve the stability and the moisture absorption, have been proposed. However, this method has disadvantages that a production process for obtaining the derivatives needs to be added and the good compatibility with ammonia deteriorates. On the other hand, the level of the improvement in the stability and the moisture absorption is not fully satisfactory. Thus, the use of a base oil comprising such a polyether compound alone is inadequate for solving the problem mentioned above. Therefore, it is required that a suitable additive is selected and used in the combination of ammonia and a base oil. However, the additive has in many cases higher activity than a base oil and it also easily reacts with ammonia. Therefore, the deterioration of the additive and the generation of precipitates are often induced.

The object of the present invention is to provide a lubricant having excellent compatibility with ammonia and moreover having excellent practical performance such as good stability and lubricity, as a lubricant for a refrigerator using ammonia as the refrigerant.

DISCLOSURE OF THE INVENTION

As a result of extensive studies, the present inventors have found that the above-described problems can be overcome by using as a lubricant base oil a polyether compound, particularly those having high ratio of secondary hydroxyl groups relative to all the hydroxyl groups located at the structural terminals, and further by adding thereto an additive selected from an antioxidant, an anti-wear additive and a metal deactivator.

According to the present invention, the following are provided based on this finding.

1. A lubricant for a refrigerator using ammonia as the refrigerant, characterized in that the lubricant contains: at least one kind of additives selected from antioxidant, anti-wear additive, and metal deactivator; and at least one polyether compound represented by the following general formula (1) or (2):

$$X\ \{—O—(AO)_n—H\}_p \qquad (1)$$

[wherein X represents a residue resulting from removing a hydroxyl group from a monool or a polyol, $(AO)_n$ represents a polyoxy alkylene chain constituted by copolymerization of an ethylene oxide and an alkylene oxide having 3 or more carbon atoms, n represents a number of 2 or more, p represents the valence of X, and the number of secondary hydroxyl groups from among hydroxyl groups located at the structural terminal is 50% or more of the total number of the hydroxyl groups]

$$X\{—O—(AO^1)_a—(AO^2)_b—H\}_p \quad (2)$$

[wherein X represents a residue resulting from removing a hydroxyl group from a monool or a polyol, $(AO^1)_a$ represents a polyoxyalkylene chain constituted by copolymerization of an ethylene oxide and an propylene oxide and/or a butylene oxide, $AO^2$represents an oxyalkylene group having 3 or more carbon atoms, a represents a number of 2 or more, b represents a number of 1 or more, and p represents the valence of X].

2. The lubricant for a refrigerator according to the above 1, characterized in that the antioxidant is an aromatic amine compound or a phenothiazine compound.

3. The lubricant for a refrigerator according to the above 1 or 2, characterized in that the metal deactivator is a benzotriazole compound.

4. The lubricant for a refrigerator according to any one of the above 1 to 3, characterized in that the anti-wear additive contains at least one kind of compounds selected from the group consisting of a fatty higher alcohol having 10 or more carbon atoms, a polyalcohol partial ester and a polyalcohol partial ether.

5. The lubricant for a refrigerator according to any one of the above 1 to 4, characterized in that one of: $(AO)_n$ in the general formula (1); and $(AO^1)_a$ in the general formula (2) is a polyoxyalkylene group constituted by any one of a random copolymer, a block copolymer, and a mixed copolymer of a random copolymerization and a block copolymerization, between ethylene oxide and propylene oxide and/or butylene oxide.

6. The lubricant for a refrigerator according to any one of the above 1 to 5, characterized in that the kinematic viscosity at 40° C. of the polyether compound represented by the general formula (1) or (2) is from 15 to 200 $mm^2/s$.

7. The lubricant for a refrigerator according to any one of the above 1 to 6, characterized in that the ratio of the oxyethylene group in one of: $(AO)_n$ in the general formula (1); and $(AO^1)_a$ in the general formula (2) is from 10 to 50% by mass.

8. The lubricant for a refrigerator according to any one of the above 1 to 7, characterized in that the unsaturation degree of the polyether compound represented by the general formula (1) or (2) is 0.05 meq/g or less.

BEST MODE FOR CARRYING OUT THE INVENTION

A polyether compound used in the present invention is employed as a so-called base oil which is a main constituent of a lubricant, and is represented by the following general formula (1) or (2):

$$X\{—O—(AO)_n—H\}_p \quad (1)$$

[wherein X represents a residue resulting from removing a hydroxyl group from a monool or a polyol, $(AO)_n$ represents a polyoxy alkylene chain constituted by copolymerization of an ethylene oxide and an alkylene oxide having 3 or more carbon atoms, n represents a number of 2 or more, p represents the valence of X, and the number of the secondary hydroxyl groups from among hydroxyl groups located at the structural terminal is 50% or more of the total number of the hydroxyl groups].

$$X\{—O—(AO^1)_a—(AO^2)_b—H\}_p \quad (2)$$

[wherein X represents a residue resulting from removing a hydroxyl group from a monool or a polyol, $(AO^1)_a$ represents a polyoxyalkylene group constituted by copolymerization of an ethylene oxide and an propylene oxide and/or a butylene oxide, $AO^2$represents an oxyalkylene group having 3 or more carbon atoms, a represents a number of 2 or more, b represents a number of 1 or more, and p represents the valence of X].

In the general formula (1) or (2), X represents a residue resulting from removing a hydroxyl group from a monool or a polyol. Examples of the monool include: alcohols such as methanol, ethanol, propanol, 2-propanol, butanol, 2-butanol, pentanol, 2-pentanol, 3-pentanol, isopentyl alcohol, 2-methyl-4-pentanol, hexanol, secondary hexanol, isohexanol, heptanol, secondary heptanol, octanol, 2-ethylhexanol, secondary octanol, isooctanol, nonanol, secondary nonanol, 1-decanol, isodecyl alcohol, secondary decanol, undecanol, secondary undecanol, 2-methyl decanol, lauryl alcohol, secondary dodecanol, 1-tridecanol, isotridecyl alcohol, secondary tridecanol, myristyl alcohol, secondary tetradecanol, pentadecanol, secondary pentadecanol, cetyl alcohol, palmityl alcohol, secondary hexadecanol, heptadecanol, secondary heptadecanol, stearyl alcohol, isostearyl alcohol, secondary octadecyl alcohol, oleyl alcohol, behenyl alcohol, eicosanol, docosanol, tetracosanol, hexacosanol, octacosanol, myricyl alcohol, laccerol, tetratriacontanol, allyl alcohol, cyclopentanol, cyclohexanol, 2-butyloctanol, 2-butyldecanol, 2-hexyloctanol, 2-hexyldecanol, 2-hexyldodecanol, 2-octyldecanol, 2-octyldodecanol, 2-octyltetradecanol, 2-decyldodecanol, 2-decyltetradecanol, 2-decylhexadecanol, 2-dodecyltetradecanol,2-dodecylhexadecanol, 2-dodecyloctadecanol, 2-tetradecyloctadecanol, 2-tetradecylicosanol, 2-hexadecyloctadecanol and 2-hexadecylicosanol; and phenols such as phenol, cresol, ethylphenol, tert-butylphenol, hexylphenol, octylphenol, nonylphenol, decylphenol, undecylphenol, dodecylphenol, tridecylphenol, tetradecylphenol, phenylphenol, benzylphenol, styrenated phenol and p-cumylphenol.

Examples of the polyol include: diols such as ethylene glycol, propylene glycol, 1,4-butanediol, 1,2-butanediol, neopentyl glycol, 1,6-hexandiol, 1,2-octanediol, 1,8-octanediol, isoprene glycol, 3-methyl-1,5-pentanediol, sorbite, catechol, resorcin, hydroquinone, bisphenol A, bisphenol F, hydrogenated bisphenol A, hydrogenated bisphenol F and dimerdiol; trihydric alcohol such as glycerol, trioxyisobutane, 1,2,3-butanetriol, 1,2,3-pentanetriol, 2-methyl-1,2,3-propanetriol, 2-methyl-2,3,4-butanetriol, 2-ethyl-1,2,3-butanetriol, 2,3,4-pentanetriol, 2,3,4-hexanetriol, 4-propyl-3,4,5-heptanetriol, 2,4-dimethyl-2,3,4-pentanetriol, pentamethylglycerol, pentaglycerol, 1,2,4-butanetriol, 1,2,4-pentanetriol, trimethylolethane and trimethylolpropane; tetrahydric alcohol such as pentaerythritol, erythritol, 1,2,3,4-pentanetetrol, 2,3,4,5-hexanetetrol, 1,2,4,5-pentanetetrol, 1,3,4,5-hexanetetrol, diglycerol and sorbitan; pentahydric alcohol such as adonitol, arabitol, xylitol and triglycerol; hexahydric alcohol such as dipentaerythritol, sorbitol, mannitol, iditol, inositol, darcitol, talose and allose; octahydric alcohol such as saccharose; polyglycerol or the dehydrated condensate thereof. p is a valence of X and is preferably a number from 1 to 8.

X may be a residue of a compound derived from the above-described monool or polyol. Examples of such a compound derived from the monool or the polyol include a sodium alcoholate or a potassium alcoholate of the monool or the polyol above.

Here, if the valence p of X is too large, the polyether compound obtained may have excessively large molecular weight and excessively high viscosity or may have reduced compatibility with an ammonia refrigerant. Therefore, the valence p of X is more preferably from 1 to 3. In particular, it is most preferable that p is 1, more specifically, X is a residue resulting from removing a hydroxyl group from a monool. Even in the case of monool, if the number of carbon atoms becomes excessively large, the polyether compound obtained may have reduced compatibility with an ammonia refrigerant and therefore, the carbon atom number of X is preferably from 1 to 8, more preferably from 1 to 4 and X is most preferably a methyl group.

In the general formula (1), $(AO)_n$ represents a polyoxyalkylene group constituted by the copolymerization of an ethylene oxide and an alkylene oxide having 3 or more carbon atoms. Examples of the alkylene oxide having 3 or more carbon atoms include propylene oxide, butylene oxide, α-olefin oxide and styrene oxide. The polymerization ratio of an ethylene oxide and an alkylene oxide having 3 or more carbon atoms is not particularly limited. However, at least the ethylene oxide is necessary in order to impart excellent compatibility with ammonia to a polyether compound which is a polymerization product.

In formula (2), $(AO^1)_a$ represents a polyoxyalkylene group constituted by the copolymerization of an ethylene oxide and a propylene oxide and/or a butylene oxide. The polymerization ratio of an ethylene oxide and a propylene oxide and/or a butylene oxide is not particularly limited. However, at least the ethylene oxide is necessary in order to impart excellent compatibility with ammonia to a polyether compound which is a polymerization product.

However, if the ratio of ethylene oxide is excessively high, the moisture absorption or the low-temperature properties such as the pour point may deteriorate, or a powder form solid may separate or precipitate. Therefore, the ratio of the oxyethylene group in $(AO)_n$ or $(AO^1)_a$ is preferably 50% by weight or less, more preferably from 50 to 5% by weight, most preferably from 30 to 5% by weight. For the same reason, the ratio of the oxyethylene group in the molecule of the polyether compound for use in the present invention, which is represented by the above-described general formula (1) or (2), is preferably 40% or less, more preferably 30% or less, and most preferably 20% or less based on the molecular weight of the polyether compound.

The form of the copolymerization may be the block polymerization, the random polymerization or a mixture of the block polymerization and the random polymerization. However, if the whole part of $(AO)_n$ or $(AO^1)_a$ are a polyoxy alkylene chain constituted by the block polymerization, the fluidity at a low temperature may deteriorate. Thus, it is particularly preferable that the $(AO)_n$ or the $(AO^1)_a$ is a polyoxy alkylene chain constituted by the random polymerization or it is a polyoxy alkylene chain partially including the random polymerization. n and a each represents a number of 2 or more, preferably 2 to 150, and more preferably 5 to 100.

The $AO^2$ in the general formula (2) represents an oxyalkylene group having 3 or more carbon atoms. Examples of the oxyalkylene group having 3 or more carbon atoms include an oxypropylene group, an oxybutylene group and an oxyalkylene group having from about 5 to 24 carbon atoms. Among these, an oxypropylene group or an oxybutylene group is preferable. b represents a number of 1 or more, preferably from 1 to 10. The $(AO^2)_b$ represents a (poly)oxyalkylene group comprising the above-described one or more oxyalkylene groups having 3 or more carbon atoms.

The lubricant of the present invention comprises a polyether compound which is represented by the general formula (1) satisfying the above-described conditions and in which the structural terminal on the opposite side of X is a hydroxyl group. In the polyether compound represented by the general formula (1) for use in the present invention, the number of the secondary hydroxyl groups, of all the hydroxyl groups located at the structural terminal, must be 50% or more of the total number of the hydroxyl groups. Further, it is more preferably 70% or more, and most preferably 80% or more. The reason is that if the secondary hydroxyl groups comprise 50% or more of all the hydroxyl groups located at the structural terminal, the polyether compound exhibits excellent stability with respect to an ammonia refrigerant, whereas if the secondary hydroxyl groups comprise less than 50% of the hydroxyl groups located at the structural terminal, the polyether compound exhibits inferior stability with respect to an ammonia refrigerant. The secondary hydroxyl group as used herein is a hydroxyl group bonding to the secondary carbon atom and the ratio of this secondary hydroxyl group can be measured by $^1$H-NMR.

In the polyether compound represented by the general formula (1) for use in the present invention, 50% or more of all the hydroxyl groups located at the structural terminal are the secondary hydroxyl groups, and therefore the polyether compound exhibits excellent stability with respect to an ammonia refrigerant. The polyether compound represented by the general formula (2) for use in the present invention has a group represented by $(AO^2)_b$—H at the structural terminal and therefore exhibits excellent stability in the presence of an ammonia refrigerant.

In general, a hydroxyl group bonding to the primary carbon atom changes into a carboxylic acid through an aldehyde if it is oxidized. However, there is a fear that a carboxylic acid produces an acid amide in the presence of ammonia and, as a result, the acid amide is precipitated. In comparison therewith, the hydroxyl group bonding to the secondary carbon atom only changes into a ketone even if it is oxidized and the ketone is stable in the presence of ammonia as compared with a carboxylic acid. Accordingly, it is presumed that the polyether compound used in the present invention can exhibit an excellent stability even in the presence of ammonia because: in the case of the polyether compound represented by the general formula (1), 50% or more of all the hydroxyl groups at the structural terminal bond to the secondary carbon atoms; and in the case of the polyether compound represented by the general formula (2), it is a polyether compound obtained by finally adding an alkylene oxide having 3 or more carbon atoms and in which the hydroxyl group at the structural terminal bonds to the secondary carbon atom. That is, the lubricant of the present invention solves a problem peculiar to a lubricant for a refrigerator using an ammonia refrigerant by selecting a lubricant having a specific structure as described above.

In the lubricant for a refrigerator using an ammonia refrigerant of the present invention, any of the polyether compounds represented by the above-described general formula (1) and (2) can be used. However, it is more preferable to use the polyether compound where the secondary hydroxyl groups from among the hydroxyl groups located at the structural terminal comprise 50% or more of all the hydroxyl groups and which has a structure represented by the above-described general formula (2).

The molecular weight of the polyether compound represented by the general formula (1) or (2) for use in the present invention is not particularly limited. However, since the molecular weight has a tendency to be proportionate to the kinematic viscosity and therefore, the molecular weight is preferably on the order of from 300 to 3,000 in order to keep the kinematic viscosity within the preferable range as described below.

The kinematic viscosity of the polyether compound represented by the general formula (1) or (2) for use in the present invention is not particularly limited. However, if the kinematic viscosity is too low, the sealability is poor and the lubricity may also decrease, whereas if the kinematic viscosity is too high, the compatibility with ammonia is lowered and the energy efficiency also deteriorates. Accordingly, the kinematic viscosity at 40° C. is preferably from 15 to 200 $mm^2/s$, more preferably from 20 to 150 $mm^2/s$.

From the viewpoint of the cooling ability of a refrigerant and the sealability of a lubricant, the ammonia as a refrigerant and the polyether lubricant represented by the general formula (1) or (2) of the present invention are preferably used at a ratio of from 99/1 to 1/99, more preferably from 95/5 to 30/70 in terms of the mass ratio.

Since the polyether compound represented by the general formula (1) or (2) for use in the present invention is a lubricant used in a refrigerator using an ammonia refrigerant, it is preferable that impurities such as moisture or chlorine are present in an amount as small as possible. Since the moisture accelerates the deterioration of the lubricant or additive, it is preferred that its content be as small as possible, preferably 500 ppm or less, more preferably 300 ppm or less and most preferably 100 ppm or less. Since a polyether compound generally has a moisture absorption property, the storage or the filling thereof in a refrigerator requires much care. However, the water can be removed by the distillation under reduced pressure or using a drier filled with a desiccant.

In the presence of ammonia, chlorine forms an ammonium salt to cause the blocking of capillary and therefore, the chlorine content is preferably as small as possible, preferably 100 ppm or less, and more preferably 50 ppm or less.

Further, during the production of the refrigerator lubricant of the present invention containing an oxypropylene group, propylene oxide may cause a side reaction to produce an allyl group having a carbon-carbon double bond. If an allyl group is produced, at first, the thermal stability of the lubricant itself decreases. Moreover, a polymerization product is produced to cause sludge and a peroxide is produced because the allyl group is easily oxidized. If a peroxide is produced and decomposed to produce a carbonyl group, the carbonyl group reacts with an ammonia refrigerant to produce an acid amide, so that the acid amide also causes blocking of capillary. Accordingly, the degree of unsaturation due to an allyl group or the like is preferably as low as possible. Specifically, this unsaturation degree is preferably 0.05 meq/g or less, more preferably 0.03 meq/g or less and most preferably 0.02 meq/g or less.

The peroxide value is preferably 10.0 meq/kg or less, more preferably 5.0 meq/kg or less and most preferably 1.0 meq/kg or less. The carbonyl value is preferably 100 ppm by weight or less, more preferably 50 ppm by weight or less and most preferably 20 ppm by weight or less.

In order to produce such a polyether compound having a low unsaturation degree represented by the general formula (1) or (2), a reaction temperature in the case of reacting a propylene oxide is preferably 120° C. or lower, more preferably 110° C. or lower. During the production of a polyether compound, if an alkali catalyst is used and, in order to remove this, an inorganic-base adsorbent such as activated carbon, activated clay, bentonite, dolomite or aluminosilicate is used, the unsaturation degree can be reduced. When producing or using the lubricant of the present invention, minimizing the contact of the lubricant with oxygen or using an antioxidant at the same time may also prevent the increase in the peroxide value or the carbonyl value.

The unsaturation degree, the peroxide value and the carbonyl value as described herein are the values measured by the following method according to Standard Methods for the Analysis of Oils established by Japan Oil Chemists' Soceity. The outline of the measurement methods is described below.

<Measurement Method of Unsaturation Degree (meq/g)>

A sample is reacted with Wijs' solution (IC1-acetic acid solution), left standing at a dark place and then, the excess IC1 is reduced to iodine, the iodine content is titrated by sodium thiosulfate to calculate the iodine number, and this iodine number converted into a vinyl equivalent amount and the value thus obtained is defined as the unsaturation degree.

<Measurement Method of Peroxide Value (meq/kg)>

Potassium iodide is added to a sample, a free iodine produced is titrated with sodium thiosulfate, and this free iodide is converted into a milliequivalent number based on 1 kg of the sample and the value obtained is defined as a peroxide value.

<Measurement Method of Carbonyl Value (ppm by Weight)>

2,4-dinitrophenylhydrazine is acted on a sample to produce chromophoric alkynoid ions, and the absorbance of this sample at a wavelength of 480 nm is measured. Then, the absorbance thus obtained is converted into the carbonyl amount based on the analytical curve previously obtained by using cinnamaldehyde as a standard reference material.

A production method of the polyether compound represented by the general formula (1) for use in the present invention is not particularly limited and a usual production method of a polyether compound may be used. For example, the polyether may be produced by a method where a mixed alkylene oxide of an ethylene oxide and an alkylene oxide having 3 or more carbon atoms (e.g. propylene oxide) is reacted with an alcohol such as methanol as a starting material at a temperature of 100 to 150° C. and under a pressure of about 0 to 10 $kg/cm^2$, in the presence of an alkali catalyst such as sodium hydroxide or potassium hydroxide.

The polyether compound represented by the general formula (2) may be produced, for example, by a method where a mixed alkylene oxide of an ethylene oxide and a propylene oxide (or butylene oxide) is reacted with an alcohol such as methanol as a starting material under the same conditions as described above and then an alkylene oxide having 3 or more carbon atoms such as propylene oxide is reacted therewith. A production method of the polyether compound represented by the general formula (2) is not particularly limited and the polyether compound may be produced by a method where a mixed alkylene oxide of an ethylene oxide and a propylene oxide (or butylene oxide) is reacted with an alcohol such as methanol as a starting material under the same conditions as described above and then an alkylene oxide having 3 or more carbon atoms such as propylene oxide is reacted therewith.

The lubricant of the present invention further contains at least one kind of additives selected from an antioxidant, an anti-wear additive and a metal deactivator.

As an antioxidant for use in the present invention, an aromatic amine-base, a phenothiazine-base, a phenol-base, a sulfur-base or a zinc thiophosphate-base antioxidant can be blended.

Among these, an aromatic amine-base compound or a phenothiazine-base compound is particularly preferable because it is a compound chemically near to ammonia as a refrigerant and therefore, is favored with high affinity and excellent compatibility with an ammonia.

Specific examples of the aromatic amine-base compound or the phenothiazine-base compound include dipyridyl amine, phenothiazine, phenothiazine derivatives obtained by adding an alkyl group to a phenylene group, dialkyldiphenylaminedipheyl-p-phenylenediamine, diphenyl-p-phenylenediamine derivatives obtained by substituting a phenyl group with a naphthyl group or an alkyl group and dialkylphenyl-p-phenylenediamine. Among these, preferred are dipyridyl amine, p,p'-dialkyldiphenylamine having an alkyl group with 4 to 20 carbon atoms (more preferably 4 to 12 carbon atoms, most preferably 8 carbon atoms) and N,N'-dialkylphenyl-p-phenylenediamine having an alkyl group with 2 to 20 carbon atoms (more preferably 4 to 12 carbon atoms).

The added amount of the antioxidant is preferably from 0.01 to 5.0% by mass, more preferably from 0.05 to 1.0% by mass based on the whole amount of the lubricant for a refrigerator of the present invention. If the added amount is small, an effect as an antioxidant cannot be obtained, whereas an addition amount thereof exceeding 5.0% by mass does not bring corresponding improvement of the effect and is therefore uneconomical. Further, an oil has a tendency to be colored if the antioxidant is excessively added. Therefore, also from this point, an excessive addition of the antioxidant should be avoided.

Representative examples of the metal deactivator for use in the present invention include benzotriazole-base compound and/or the derivatives thereof. The benzotriazole derivative as said herein is a compound represented by the following formula (3):

(3)

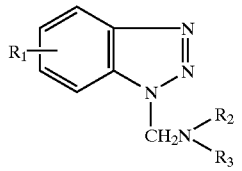

[wherein $R_1$, $R_2$ and $R_3$, which may be the same or different, each is hydrogen, an alkyl group having from 1 to 20 carbon atoms or an aryl group having from 1 to 20 carbon atoms]. It is presumed that these compounds have a function of covering the metal surface to protect the metal material from corrosive substances such as ammonia refrigerant or the like.

In the lubricant for a refrigerator of the present invention, the added amount of the metal deactivator is not particularly limited and may be appropriately selected according to the circumstance, however, it is preferably from 1 to 200 ppm by mass, more preferably from 5 to 50 ppm by mass based on the entire amount of the lubricant.

Examples of the anti-wear additive for use in the present invention include phosphate-base compound such as tricresyl phosphate and triphenyl phosphate, alcohol-base compound such as fatty higher alcohol, polyalcohol ester or polyalcohol ether or N-hydrocarbylalkanolamine. In particular, the anti-wear additive preferably contains at least one kind of compounds selected from the group consisting of fatty higher alcohol having 10 or more carbon atoms, polyalcohol partial ester and polyalcohol partial ether.

Herein, examples of the fatty higher alcohol having 10 or more carbon atoms include fatty alcohol such as 1-decanol, isodecyl alcohol, secondary decanol, undecanol, secondary undecanol, 2-methyldecanol, laurylalcohol, secondary dodecanol, 1-tridecanol, isotridecyl alcohol, secondary tridecanol, myristyl alcohol, secondary tetradecanol, pentadecanol, secondary pentadecanol, cetyl alcohol, palmityl alcohol, secondary hexadecanol, heptadecanol, secondary heptadecanol, stearyl alcohol, isostearyl alcohol, secondary octadecyl alcohol, oleyl alcohol, behenyl alcohol, eicosanol, docosanol, tetracosanol, hexacosanol, octacosanol, myricyl alcohol, laccerol, tetratriacontanol, allyl alcohol, cyclopentanol, cyclohexanol, 2-butyloctanol, 2-butyldecanol, 2-hexyloctanol, 2-hexyldecanol, 2-hexyldodecanol, 2-octyldecanol, 2-octyldodecanol, 2-octyltetradecanol, 2-decyldodecanol, 2-decyltetradecanol, 2-decylhexadecanol, 2-dodecyltetradecanol,2-dodecylhexadecanol, 2-dodecyloctadecanol, 2-tetradecyloctadecanol, 2-tetradecylicosanol, 2-hexadecyloctadecanol and 2-hexadecylicosanol.

The polyalcohol partial ester is a compound represented by the following general formula (4):

$$R_4(OH)_h\{OC(O)R_5\}_k \quad (4)$$

[wherein $R_4$represents a linear or branched, saturated or unsaturated hydrocarbon group having from 2 to 12 carbon atoms corresponding to the residue of polyalcohol having (h+k) valence, $R_5$ represents a linear or branched, saturated or unsaturated hydrocarbon group having from 3 to 20 carbon atoms, h represents the number of hydroxyl group which is not esterified and remains, k represents the number of acyl group esterified, and h and k each is a positive number satisfying $1 \leqq h<6$, $1 \leqq k<6$and $2 \leqq h+k \leqq 6$]. More specifically, the polyalcohol partial ether is a partial ether obtained by reacting a polyalcohol such as glycol, glycerol, trimethylolpropane, pentaerythritol, sorbitan or sorbitol with a linear or branched, saturated or unsaturated fatty acid having from 3 to 20 carbon atoms. Among these, preferred is a partial ether obtained by reacting a polyalcohol such as glycerol, sorbitan or sorbitol with a fatty acid having from 10 to 20 carbon atoms, more preferred is a monofatty acid ester, most preferred is a monofatty acid ester of glycerol.

The polyalcohol partial ether is a compound represented by the following general formula (5):

$$R_6(OH)_r\{OR_7\}_s \quad (5)$$

[wherein $R_6$ represents a linear or branched, saturated or unsaturated hydrocarbon group having from 2 to 12 carbon atoms corresponding to the residue of polyalcohol having (r+s) valence, $R_7$ represents a linear or branched, saturated or unsaturated hydrocarbon group having from 3 to 20 carbon atoms, r represents the number of hydroxyl group which is not etherified and remains, s represents the number of ether linkage etherified, and r and s each is a positive number satisfying $1 \leqq r<6$, $1 \leqq s<6$ and $2 \leqq r+s \leqq 6$]. More specifically, the polyalcohol partial ether is a partial ether obtained by condensing a polyalcohol such as glycol, glycerol, trimethylolpropane, pentaerythritol, sorbitan or sorbitol with a linear or branched, saturated or unsaturated monool having from 3 to 20 carbon atoms. Among these, preferred is a partial ether obtained by condensing a polyalcohol such as glycerol, sorbitan or sorbitol with a fatty alcohol having from 10 to 20 carbon atoms, more preferred is monoalkyl or alkenyl ether, most preferred is monoalkyl or alkenyl ether of glycerol.

Examples of the N-hydrocarbylalkanolamine include long chain alkylalkanolamines such as N-butyl monoethanolamine, N-hexyl monoethanolamine, N-cyclohexyl monoethanolamine, N-octyl monoethanolamine, N-decyl monoethanolamine, N-coconut oil alkyl monoethanolamine, N-tallow derivation alkyl monoethanolamine, N-soybean oil derivation alkyl monoethanolamine, N-oleyl monoethanolamine, N-stearyl monoethanolamine, N-butyl diethanolamine, N-hexyl diethanolamine, N-cyclohexyl diethanolamine, N-octyl diethanolamine, N-decyl diethanolamine, N-coconut oil alkyl diethanolamine, N-tallow derivation alkyl diethanolamine, N-soybean oil derivation alkyl diethanolamine, N-oleyl diethanolamine, N-stearyl diethanolamine, N,N-dibutyl monoethanolamine, N,N-dihexyl monoethanolamine, N,N-dicyclohexyl monoethanolamine, N,N-dioctyl monoethanolamine, N,N-didecyl monoethanolamine, N,N-bis (coconut oil derivation alkyl) monoethanolamine, N,N-bis (tallow derivation alkyl) monoethanolamine, N,N-bis (soybean oil derivation alkyl) monoethanolamine, N,N-dioleyl monoethanolamine and N,N-distearyl monoethanolamine or the alkylene oxide adducts thereof.

In the lubricant for a refrigerator of the present invention, the added amount of the anti-wear additive is not particularly limited and may be appropriately selected according to the circumstances, however, it is preferably from 0.1 to 2.0% by mass, more preferably from 0.2 to 1.0% by mass based on the entire amount of the lubricant.

The lubricant for a refrigerator of the present invention contains at least one kind of additives selected from the above-described antioxidant, anti-wear additive and metal deactivator. Needless to say, the present invention also includes the case of using an antioxidant, an anti-wear additive and a metal deactivator at the same time. The lubricant for a refrigerator of the present invention more preferably contains an additive constituted by using at least one kind of compounds selected from each of the above-described antioxidant, anti-wear additive and metal deactivator respectively.

Further, in the lubricant for a refrigerator of the present invention, for example, a commonly known refrigerator lubricant base oil such as naphthenic mineral oil or synthetic oil such as alkylbenzene oil, ether oil, ester oil, and fluorine or other commonly known additives may be appropriately blend, if desired.

Examples of other commonly known additives include a stabilization agent such as phenylglycidyl ether and alkylglycidyl ether, a defoaming agent or a foam suppressor such as polydimethyl siloxane and polymethacrylate. A defoaming agent or a foam suppressor other than the above-described ones, a detergent-dispersant, a viscosity index improver, a corrosion inhibitor and a pour point depressant can be blended, if desired. These additives are usually blended so as to be incorporated in an amount of about 10 ppm by mass to 10% by mass in the lubricant of the present invention.

A refrigerant used together with the lubricant for a refrigerator of the present invention is an ammonia refrigerant; however, the ammonia refrigerant should be understood as a refrigerant containing ammonia. More specifically, of course, a two-kind mixed refrigerant comprising ammonia and a hydrocarbon compound having a low molecular weight or ammonia and the above-described fluorohydrocarbon, and a three-kind mixed refrigerant comprising ammonia, a fluorohydrocarbon compound having a low molecular weight and the above-described fluorohydrocarbon also correspond to the ammonia refrigerant used in the present invention, to say nothing about a refrigerant only comprising ammonia.

The lubricant for a refrigerator of the present invention and an ammonia refrigerant may be filled at an appropriate ratio according to the specification of the refrigeration system applied. More specifically, these are filled preferably at a ratio of 99/1 to 1/99, more preferably at a ratio of 95/5 to 30/70 in terms of the mass ratio of ammonia refrigerant/lubricant for refrigerator.

EXAMPLES

The present invention is described in greater detail below referring to Examples, but the present invention is not limited to Examples. In Examples, the % expresses % by mass, the ratio expresses mass ratio.

Examples 1 to 12 and Comparative Examples 1 to 10

As a base oil of a lubricant for refrigerator, the following five kinds of polyether compounds were used. To these base oils, the following antioxidant (two kinds), metal deactivator (one kind) and anti-wear additive (three kinds) each was added as an additive in an added amount shown in Table 1 and mixed to prepare the lubricant compositions as sample oils, which are subjected to the evaluation tests respectively, in Examples and Comparative Examples. These sample oils were subjected to the evaluation tests of the stability by the sealed tube test, the lubricity by the Falex seizure load and the compatibility with an ammonia refrigerant.

<Base Oil>

PAG1: $CH_3O\ (PO)_m/(EO)_n\ H$ m/n=8/2, kinematic viscosity (40° C.)=46 $mm^2/s$ terminal secondary hydroxyl group ratio: 90% molecular weight: 1,000

PAG2: $CH_3O\ (PO)_m/(EO)_n\ H$ m/n=7/3, kinematic viscosity (40° C.)=46 $MM^2/S$ terminal secondary hydroxyl group ratio: 60% molecular weight: 1,040

PAG3: $CH_3O\ (PO)_m/(EO)_n\ H$ m/n=6/4, kinematic viscosity (40° C.)=46 $mm^2/s$ terminal secondary hydroxyl group ratio: 40% molecular weight: 1,060

PAG4: $CH_3O\ (PO)_m/(EO)_n\ CH_3$ m/n=8/2, kinematic viscosity (40° C.)=46 $mm^2/s$ molecular weight: 1,000

PAG5: $CH_3O\ (PO)_m\ H$ kinematic viscosity (40° C.)=50 $mm^2/s$ molecular weight: 950

PAG6: $CH_3O\ (PO)_m/(EO)_n—(PO)_2—H$ m/n=6/4, kinematic viscosity (40° C.)=54 $mm^2/S$ terminal secondary hydroxyl group ratio: 90% molecular weight: 1,170

[wherein PO represents an oxypropylene group, EO represents an oxyethylene group. (PO)/(EO) represents a random addition of PO and EO.]

PAG 1 and PAG 2 are included in the polyether compound represented by the general formula (1) or (2) in the present invention and PAG 6 is included in the polyether compound represented by the general formula (2) in the present invention. However, PAG 3 is a base oil where the ratio of terminal secondary hydroxyl group is less than 50% based on the whole hydroxyl group, PAG 4 is a base oil where the both terminals thereof are blocked up by methyl groups, PAG 5 is a base oil not containing an oxyethylene group and all of them are not included in the present invention.

<Additive>

(i) Antioxidant (Two Kinds)

DOPA: p,p'-di-octyl-di-phenylamine

DBPC: 2,6-di-tertiary butyl-p-cresol (ii) Metal Deactivator (One Kind)

BTA: benzotriazole (iii) Anti-Wear Additive (Three Kinds)

GMOE: glycerol monooleyl ether

GMO: glycerol monoolate

TCP: tricresyl phosphate

TABLE 1

| | | Additives | | | | | |
|---|---|---|---|---|---|---|---|
| | Base material | Antioxidant | Added amount (% by mass) | Metal deactivator | Added amount (ppm by mass) | Anti-wear additive | Added amount (ppm by mass) |
| Example 1 | PAG 1 | DOPA | 0.05 | — | — | — | — |
| Example 2 | PAG 1 | DOPA | 0.1 | — | — | — | — |
| Example 3 | PAG 2 | DOPA | 0.05 | — | — | — | — |
| Example 4 | PAG 1 | DOPA | 0.05 | BTA | 10 | — | — |
| Example 5 | PAG 1 | DOPA | 0.05 | BTA | 20 | — | — |
| Example 6 | PAG 1 | DOPA | 0.05 | — | — | GMOE | 0.5 |
| Example 7 | PAG 1 | DOPA | 0.05 | — | — | GMOE | 1.0 |
| Example 8 | PAG 1 | DOPA | 0.05 | — | — | GMO | 0.5 |
| Example 9 | PAG 2 | DOPA | 0.05 | — | — | GMOE | 0.5 |
| Example 10 | PAG 1 | DOPA | 0.05 | BTA | 10 | GMOE | 0.5 |
| Example 11 | PAG 2 | DOPA | 0.05 | BTA | 10 | GMOE | 0.5 |
| Example 12 | PAG 6 | DOPA | 0.05 | BTA | 10 | GMOE | 0.5 |
| Comparative Example 1 | PAG 1 | — | — | — | — | — | — |
| Comparative Example 2 | PAG 2 | — | — | — | — | — | — |
| Comparative Example 3 | PAG 6 | — | — | — | — | — | — |
| Comparative Example 4 | PAG 3 | DBPC | 0.1 | — | — | — | — |
| Comparative Example 5 | PAG 3 | — | — | — | — | TCP | 0.5 |
| Comparative Example 6 | PAG 3 | DOPA | 0.05 | BTA | 10 | GMOE | 0.5 |
| Comparative Example 7 | PAG 4 | — | — | — | — | — | — |
| Comparative Example 8 | PAG 4 | DOPA | 0.05 | BTA | 10 | GMOE | 0.5 |
| Comparative Example 9 | PAG 5 | — | — | — | — | — | — |
| Comparative Example 10 | PAG 5 | DOPA | 0.05 | BTA | 10 | GMOE | 0.5 |

<Performance Evaluation Test of Lubricant>

(i) Stability Test (Sealed Tube Test)

In accordance with JIS K 2211, a sealed tube was manufactured by filling 8 ml of each sample oil in Examples and Comparative Examples shown in Table 1 and 2 ml of ammonia refrigerant (R717) to a bomb together with iron and an aluminum catalyst. These sealed tubes were heated and kept at 150° C. for 14 days and then, the appearance of these sample oils and catalysts thus deteriorated was observed with eyes and evaluated. The evaluation was based on five-scale evaluation such that if the appearance of sample oils and catalysts after the deterioration was the same as the one in the beginning, it was evaluated as "no change" and if a deposit was observed in a sample oil and a discoloration was observed in a catalyst, the sample oil and the catalyst where the degree of such change was most serious were evaluated as "deposit 5" and "discoloration 5" respectively.

In accordance with JISK2580 ASTM color test method, a color of each sample oil after the deterioration was measured. More specifically, the color of the sample oil was compared with the color of ASTM color standard glass and the results thereof were expressed by values in increments of 0.5 within the range of from 0.5 to 8.0. When the sample oil color is judged to be from 1.0 to 1.5, a darker color in the standard glass (in this case, it is 1.5) is adopted and the sample oil color is expressed as [L1.5] by attaching L.

(ii) Lubricity Test (Falex Seizure Load Test)

In accordance with ASTM D2670, a steel (AISIC-1137)-made block and a steel (SAE 3135)-made pin were used to apply a load an initial temperature of 40° C. and a rotating speed of 290 rpm, and the load at the time of seizure was measured.

(iii) Compatibility Test (Measurement of Two-layer Separation Temperature)

In accordance with JIS K2211 appendix 3, the two-layer separation temperature in the mixture of a sample oil/R717 (ammonia refrigerant)=2/8 was measured.

The results of these evaluation tests are shown in Table 2. The "Fe discoloration" in the catalyst appearance evaluation results of the sealed tube test expresses that a discoloration at the level as shown in Table 2 was observed on the iron in the catalyst, but that a discoloration was not observed on the aluminum.

TABLE 2

| | Sealed tube Test | | | | |
|---|---|---|---|---|---|
| | Color (ASTM) | Appearance of sample oil | Appearance of catalyst | Falex seizure load (N) | Two-layer separation temperature (° C.) |
| Example 1 | L0.5 | No change | Fe Discoloration 2 | 3825 | −9 |
| Example 2 | L1.0 | No change | Fe Discoloration 1 | 3781 | −9 |
| Example 3 | L1.5 | No change | Fe Discoloration 2 | 4003 | −16 |
| Example 4 | L0.5 | No change | No change | 3870 | −9 |
| Example 5 | L0.5 | No change | No change | 3914 | −9 |
| Example 6 | L0.5 | No change | Fe Discoloration 1 | 4137 | −7 |
| Example 7 | L1.0 | No change | Fe Discoloration 1 | 4226 | −6 |
| Example 8 | L0.5 | No change | Fe Discoloration 2 | 4048 | −7 |
| Example 9 | L0.5 | No change | Fe Discoloration 2 | 4359 | −14 |
| Example 10 | L1.0 | No change | No change | 4181 | −7 |
| Example 11 | L1.5 | No change | No change | 4404 | −13 |
| Example 12 | L0.5 | No change | Fe Discoloration 1 | 4137 | −16 |
| Comparative Example 1 | L2.5 | Deposit 5 | Fe Discoloration 5 | 3736 | −9 |
| Comparative Example 2 | L3.0 | Deposit 5 | Fe Discoloration 4 | 3914 | −16 |
| Comparative Example 3 | L2.0 | Deposit 2 | Fe Discoloration 4 | 4003 | −16 |
| Comparative Example 4 | L3.5 | Deposit 4 | Fe Discoloration 4 | 4092 | Room Temperature Separation |
| Comparative Example 5 | L4.5 | Deposit 5 | Fe Discoloration 5 | 4582 | −24 |
| Comparative Example 6 | L3.0 | Deposit 3 | Fe Discoloration 2 | 4448 | −22 |
| Comparative Example 7 | L1.5 | Deposit 2 | Fe Discoloration 4 | 3470 | 11 |
| Comparative Example 8 | L0.5 | No change | No change | 3736 | 12 |
| Comparative Example 9 | L1.0 | Deposit 1 | Fe Discoloration 4 | 3114 | Room Temperature Separation |
| Comparative Example 10 | L0.5 | No change | No change | 3336 | |

According to Table 2, in the sample oils (Examples 1 to 3) having added thereto an aromatic amine-base compound or phenothiazine-base compound as an antioxidant, a discoloration is observed on the appearance of the catalysts in sealed tube test but is of a tolerable level. The sample oils (Examples 4 and 5) having added thereto benzotriazole as a metal deactivator, and the sample oils (Examples 6 to 9) having added thereto glycerol monooleyl ether or glycerol monooleate as an anti-wear additive, in addition to the aromatic amine compound or the phenothiazine compound, are all improved in their performance such as stability and lubricity than oils in Examples 1 to 3. The sample oils (Examples 10 to 12) having added thereto an aromatic amine compound or a phenothiazine compound, or benzotriazole and glycerol monooleyl ether have further improved performance. All oils have sufficient compatibility with an ammonia refrigerant.

On the other hand, the sample oils in Comparative Examples 1 to 3, which are composed of a PAG1, PAG2 or PAG6 alone without an additive added thereto, are extremely poor in terms of the appearance of the sample oils and the catalysts as tested by the sealed tube test, as compared with the sample oils in Examples.

The sample oils in Comparative Examples 4 to 6 are obtained by adding an additive to PAG 3 not included in the present invention. These sample oils also have poor sealed tube test results and have a problem in the stability as compared with the sample oils in Examples.

The sample oils in Comparative Examples 7 to 10 comprise PAG4 or PAG5 alone, which is not included in the present invention, or are sample oils obtained by adding an additive to the PAG4 or the PAG5. These sample oils have a poor compatibility with an ammonia refrigerant and have a problem in the lubricity.

Industrial Applicability

The present invention is a refrigerator lubricant using a specific polyether compound as a base oil and containing at least one kind of additives selected from antioxidant, anti-wear additive and metal deactivator, which exhibits a remarkable effect that the performance such as stability and lubricity as well as compatibility with ammonia is extremely improved, and is useful as a lubricant for a refrigerator using an ammonia refrigerant.

What is claimed is:

1. A lubricant for a refrigerator using ammonia as the refrigerant, characterized in that the lubricant contains: at least one kind of additive selected from antioxidant, anti-wear additive, and metal deactivator; and at least one polyether compound having an unsaturation degree of 0.05 meg/or less represented by the following general formula (1) or (2):

$$X\{—O—(AO)_n—H\}_p \quad (1)$$

$$X\{—O—(AO^1)_a—(AO^2)_b—H\}_p \quad (2)$$

2. The lubricant for a refrigerator according to the above 1, characterized in that the antioxidant is an aromatic amine compound or a phenothiazine compound.

3. The lubricant for a refrigerator according to claim 1, characterized in that the metal deactivator is a benzotriazole compound.

4. The lubricant for a refrigerator according to claim 1, characterized in that the anti-wear additive contains at least one kind of compounds selected from the group consisting of a fatty higher alcohol having 10 or more carbon atoms, a polyalcohol partial ester and a polyalcohol partial ether.

5. The lubricant for a refrigerator according to claim 1, characterized in that one of: $(AO)_n$ in the general formula (1); and $(AO^1)_a$ in the general formula (2) is a polyoxyalkylene group constituted by any one of a random copolymer, a block copolymer, and a mixed copolymer of a random copolymerization and a block copolymerization, between ethylene oxide and propylene oxide and/or butylene oxide.

6. The lubricant for a refrigerator according to claim 1, characterized in that the kinematic viscosity at 40° C. of the polyether compound represented by the general formula (1) or (2) is from 15 to 200 $mm^2/s$.

7. The lubricant for a refrigerator according to claim 1, characterized in that the ratio of the oxyethylene group in one of: $(AO)_n$ in the general formula (1); and $(AO^1)_a$ in the general formula (2) is from 5 to 50% by mass.

* * * * *